United States Patent [19]

Krull

[11] 4,244,206

[45] Jan. 13, 1981

[54] TOOTHED BELT PULLEY

[76] Inventor: Lore Krull, Gütersloher Strasse 40, 4803 Steinhagen, Fed. Rep. of Germany

[21] Appl. No.: 18,309

[22] Filed: Mar. 7, 1979

[30] Foreign Application Priority Data

Mar. 8, 1978 [DE] Fed. Rep. of Germany ..... 2809872

[51] Int. Cl.[3] ..... B21K 1/30; B21K 1/42

[52] U.S. Cl. ..... 72/377; 72/356; 29/159 R; 29/159.2; 474/152

[58] Field of Search ..... 113/116 D; 29/159 R, 29/159.1, 159.2, 159.3; 74/230.01, 230.05, 230.5, 230.8; 72/341, 356, 377, 68, 367

[56] References Cited

U.S. PATENT DOCUMENTS 1,506,435 8/1924 Martin ..... 29/159.3

4,062,701 12/1977 Juhas ..... 29/159.3

4,098,137 7/1978 Yaros ..... 29/159 R

FOREIGN PATENT DOCUMENTS 1324090 7/1973 United Kingdom ..... 29/159 R

*Primary Examiner*—Lowell A. Larson

*Attorney, Agent, or Firm*—Hammond & Littel, Weissenberger and Muserlian

[57] ABSTRACT

A method for the production of a toothed belt pulley made of metal without machining which is provided at lateral sides with annular flanges which protrude above the height of the teeth comprising initially shaping one of the two flanges as an axially extending collar with an outside diameter equal to or less than the diameter of the pitch circle of the teeth and then radially flanging the said collar to the outside to form the second annular flange and the pulley formed thereby.

1 Claim, 2 Drawing Figures

TOOTHED BELT PULLEY

STATE OF THE ART

Figure 1:
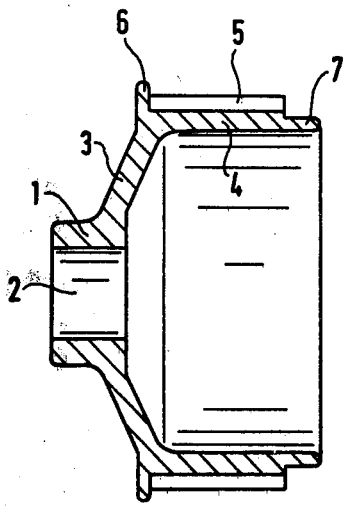

Toothed belt pulleys are known and are used, for example, for the camshaft drive in internal combustion engines but the known pulleys have a rather complicated construction. One known pulley consists of a solid massive hub or nave which is produced on a metal lathe to which are connected three sheet metal parts forming the outer circle track with flanges on either side as well as the area connecting the circle track with the nave. One sheet metal part forms the toothed track for the toothed belt while the other two sheet metal parts form the lateral borders. The three sheet metal parts are joined together and with the nave by hand soldering. Because of the need for four individual elements and the elaborate connection for the assembly of the elements, the manufacture of the said belt pulleys is relatively complicated and expensive.

Another known pulley is supposed to allow a simplified manufacture by first making the tooth depth of the tooth belt pulley overly large and then reducing it to its normal size by machining it in the center. The remaining parts at the edge of the toothing with the original height act as lateral guides for the toothed belt. This results in no annular borders but individual teeth projecting over the toothing which lead to damages on the lateral edges of the toothed belt.

OBJECTS OF THE INVENTION

It is an object of the invention to provide a novel time-saving, inexpensive method of producing a toothed belt pulley not made of a plurality of parts.

It is another object of the invention to provide a novel toothed belt pulley.

These and other objects and advantages of the invention will become obvious from the following detailed description.

THE INVENTION

The novel method of the invention for the production of a toothed belt pulley made of metal without machining which is provided at lateral sides with annular flanges which protrude above the height of the teeth comprises initially shaping one of the two flanges as an axially extending collar with an outside diameter equal to or less than the diameter of the pitch circle of the teeth and then radially flanging to said collar to the outside to form the second annular flange.

Figure 2:
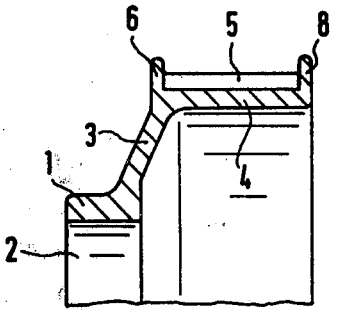

Referring now to the drawings:

FIG. 1 is a cross-sectional view of the pulley of the invention before the second flange is formed and FIG. 2 is a partial cross-sectional view showing the pulley after the second flange has been formed.

In FIGS. 1 and 2, the toothed belt pulley is comprised of nave 1 which has a bore 2 for receiving a shaft and which is connected by disc shaped flange 3 with outer circle track 4 which carries on its outer surface a tooth belt 5 which is form-locking engaged by the teeth of the toothed belt during operation.

In FIG. 1, the outer circle track 4 is provided on one side with a outward radially extending flange 6 and at the other side is molded in the first production step to form an axially extending collar 7 with an outside diameter less than the diameter of the pitch circle of toothing 5. FIG. 2 shows the toothed belt pulley after the second production step in which axially extending collar 7 is outwardly radially flanged to form lateral flange 8.

Various modifications of the method and article of the invention may be made without departing from the spirit or scope thereof and it is to be understood that the invention is intended to be limited only as defined in the appended claims.

I claim:

1. A method for the production of a toothed belt pulley made of metal without machining which is provided at lateral sides with annular flanges which protrude above the height of the teeth comprising initially shaping one of the two flanges as an axially extending collar with an outside diameter equal to or less than the diameter of the pitch circle of the teeth and then radially flanging the said collar to the outside to form the second annular flange.

* * * * *